US011590990B2

(12) United States Patent
Lainé et al.

(10) Patent No.: US 11,590,990 B2
(45) Date of Patent: Feb. 28, 2023

(54) CABLE TRANSPORTATION SYSTEM COMPRISING A STATION AND METHOD FOR OPERATING SUCH CABLE TRANSPORTATION SYSTEM

(71) Applicant: LEITNER S.P.A., Vipiteno (IT)

(72) Inventors: Sylvain Lainé, Vipiteno (IT); Denis Ribot, Vipiteno (IT)

(73) Assignee: LEITNER S.P.A., Vipiteno (IT)

( * ) Notice: Subject to any disclaimer, the term of this patent is extended or adjusted under 35 U.S.C. 154(b) by 416 days.

(21) Appl. No.: 16/960,803

(22) PCT Filed: Jan. 11, 2019

(86) PCT No.: PCT/IB2019/050230
§ 371 (c)(1),
(2) Date: Jul. 8, 2020

(87) PCT Pub. No.: WO2019/138373
PCT Pub. Date: Jul. 18, 2019

(65) Prior Publication Data

US 2021/0101627 A1 Apr. 8, 2021

(30) Foreign Application Priority Data

Jan. 12, 2018 (IT) ..... 102018000000833

(51) Int. Cl.
*B61B 7/00* (2006.01)
*B61B 12/02* (2006.01)
*B61B 1/00* (2006.01)

(52) U.S. Cl.
CPC ..... *B61B 12/022* (2013.01); *B61B 1/00* (2013.01); *B61B 7/00* (2013.01)

(58) Field of Classification Search
CPC ..... B61B 12/022; B61B 12/02; B61B 12/105; B61B 1/00; B61B 7/00; B61B 7/04
See application file for complete search history.

(56) References Cited

U.S. PATENT DOCUMENTS 4,744,306 A * 5/1988 Kunczynski ..... B61B 12/105 104/168
6,389,980 B1 * 5/2002 Croses ..... B61B 1/02 104/178

(Continued)

FOREIGN PATENT DOCUMENTS

| | | |
|---|---|---|
| FR | 2945780 | 11/2010 |
| FR | 2970929 | 8/2012 |
| JP | 2002321614 | 11/2002 |

OTHER PUBLICATIONS

Notification concerning Submission, Obtention or Transmittal of Priority Document for International Search Report and Written Opinion for International Application No. PCT/IB2019/050230 dated Feb. 27, 2019.

(Continued)

*Primary Examiner* — Mark T Le
(74) *Attorney, Agent, or Firm* — Neal, Gerber & Eisenberg LLP

(57) ABSTRACT

A station for a cable transportation system comprising a plurality of transporting units supported and driven outside the station by at least one cable, the station comprising an inlet and an outlet for the transporting units; a guiding device for guiding the transporting units uncoupled from the cable inside the station; an advancing auxiliary device for moving the transporting units along the guiding device; a control unit configured for controlling the advancing auxiliary device so that the advancing auxiliary device can switch, with no service interruption, from a first configuration, wherein the transporting units are individually arranged equidistant from each other and the boarding and landing occur inside the station without stopping the advancing (Continued)

movement, to a second configuration, wherein the transporting units are arranged in equidistant compact groups of at least two units and the boarding and landing occur inside the station by temporarily stopping the transporting units, and vice versa.

12 Claims, 3 Drawing Sheets

(56) References Cited

U.S. PATENT DOCUMENTS 7,559,281 B2 * 7/2009 Huard ..... B61B 12/105
104/178
7,806,055 B2 * 10/2010 Michel ..... B61B 12/022
104/173.1
2007/0034105 A1 * 2/2007 Mugnier ..... B61B 7/04
104/178
2012/0266776 A1 * 10/2012 Peterson ..... B60L 13/03
105/149.2
2014/0069292 A1 * 3/2014 Duer ..... B61B 11/00
104/197
2016/0059867 A1 * 3/2016 Babaz ..... B61B 12/06
104/112

OTHER PUBLICATIONS

International Search Report and Written Opinion for International Application No. PCT/IB2019/050230 dated May 6, 2019.
PCT Demand for International Preliminary Examination and Reply to International Search Report and the associated Written Opinion for International Application No. PCT/IB2019/050230 dated Nov. 11, 2019.
Notification of Receipt of Demand by Competent International Preliminary Examining Authority (Form PCT/IPEA/402) for International Application No. PCT/IB2019/050230 dated Nov. 15, 2019.
Notification of Transmittal of the International Preliminary Report on Patentability (Form PCT/IPEA/416) for International Application No. International Application No. PCT/IB2019/050230 dated Jan. 15, 2020.

* cited by examiner

CABLE TRANSPORTATION SYSTEM COMPRISING A STATION AND METHOD FOR OPERATING SUCH CABLE TRANSPORTATION SYSTEM

PRIORITY CLAIM

This application is a national stage application of PCT/IB2019/050230, filed on Jan. 11, 2019, which claims the benefit of and priority to Italian Patent Application No. 102018000000833, filed on Jan. 12, 2018, the entire contents of which are each incorporated by reference herein.

TECHNICAL FIELD

The present disclosure relates to a cable transportation system. In particular, the present disclosure relates to a station of a cable transportation system for the boarding and landing of passengers or materials that are transported outside the station by transporting units, for example chairs or cabins or the like, driven and/or supported by at least one cable.

BACKGROUND

As is known, a station of a cable transportation system comprises an inlet and an outlet for the transporting units arranged in series one after the other. At the inlet and the outlet, respectively, the station is provided with devices for uncoupling and coupling the transporting units from/to the cable. This selective uncoupling of the transporting units from the cable inside the station has the purpose of allowing the slowing down of the transporting units passing through the station without however slowing down the remaining transporting units moving outside the station.

Within this type of stations, the provision of a guide system configured to support the transporting units when uncoupled from the cable and to guide them from the inlet to the outlet of the station is known. This guiding device is usually in the form of at least one track located above the transporting unit, which extends, in plan view, from the inlet to the outlet of the station where the guiding device ends at a cable coupling device. Beyond the coupling device, the transporting unit is coupled, for example clamped, to the cable and proceeds to the next station of the system.

The plan extent of the guiding device inside the station as defined above can be divided into a succession of portions or sections. In particular, it is possible to identify:

- an inlet portion delimited upstream by the station entry point, where the cable uncoupling device is housed, and along which the transporting unit is slowed down;
- an intermediate portion where the boarding and landing take place; and
- an outlet portion delimited downstream by the station exit point, where the cable coupling device is housed, and along which the transporting unit is accelerated up to a speed such as to allow a secure coupling to the cable (i.e., without jerks).

The indicated terms "upstream" and "downstream" refer to the direction of advance of the transporting unit in the station, and the inlet and outlet portions are spaced apart so as to simultaneously enable the entry and exit of the transporting units into/from the station. Even outside the station, the system provides two spaced and parallel paths for the movement of the transporting units in opposite directions.

To maximize the hourly capacity of the system, it is common practice in certain of the prior art not to stop the transporting units during the boarding and landing procedures. Therefore, along the intermediate guide portions, the transporting units advance at a relatively constant low speed.

In this configuration, the stopping of the transporting units is also not allowed in view of the relatively short time interval separating a transporting unit from the preceding one. In case of stopping, collisions may occur between the stopped unit and the preceding (i.e., upstream), one that is moving forward.

However, there are also conditions in which it would be desirable to be able to perform the boarding and landing procedures with the transporting units stationary. Such conditions occur both in urban systems, where users are used to getting on or off stationary means of transport, and also in ski or mountain systems during relatively low-traffic service periods. For example, during the evening hours these mountain systems no longer require a relatively high hourly capacity and sometimes these systems are used by non-sports users simply for the purpose of reaching high-altitude meeting places, such as restaurants or the like.

Unfortunately, for the reasons indicated above, which can be summarized in the relatively low distance between the transporting units, these transporting units, which during the day perform the boarding and landing while moving, cannot be stopped inside the station.

Currently, only one procedure is known to allow a system to switch between a "daytime" or high-traffic service configuration, with boarding and landing in movement, and a "night-time" or low-traffic service configuration, with boarding and landing while the transporting units are stationary. In particular, this procedure is known to provide for physically extracting a few transporting units from the line so as to obtain a greater distance between the remaining units in use.

However, according to this known procedure, during the transition from one configuration to the other the system is not in operation. For example, French Patent No. FR2970929 and Japanese Patent No. JP2002321614 disclose cable transportation systems wherein the transporting units are arranged in equidistant compact groups.

Additionally, French Patent No. FR2945780 discloses a cable transportation systems wherein the transporting units are individually equidistant.

SUMMARY

The object of the present disclosure is to provide an alternative transportation system with a station, which is capable of solving certain of the above mentioned problems of certain of the prior art.

According to the disclosure, the station comprises an inlet and an outlet, in certain embodiments spaced apart, for the transit of a plurality of transporting units, for example cabins, chairs or the like, arranged in series one after the other. Outside the station, the transporting units are driven, and possibly supported, by at least one cable. Inside the station, the same transporting units are uncoupled from the hauling cable, and supported and guided along a suitable guiding device, such as, for example, tracks. To this end, at the inlet and the outlet, the station is thus provided with cable uncoupling and coupling devices. Inside the station, the guiding device extends, in plan view, between the inlet and the outlet and comprises an inlet guide, at least one intermediate guide, and an outlet guide. In certain embodiments, the station is an upstream or downstream station and, in plan view, is U-shaped, wherein the inlet and the outlet are separate from each other so as to simultaneously enable the entry and exit of the transporting units. The deceleration along the inlet guide, the advance at a constant speed and/or any stop along the intermediate guide, and the acceleration along the outlet guide are imparted to the transporting units by a suitable advancing auxiliary device. This advancing auxiliary device, therefore, extends along substantially all of the guiding device and may comprise a plurality of motorized wheels, a linear motor, etc.

The station of the present disclosure further comprises a control unit, which can also be the control unit of the entire system, configured to operate the advancing auxiliary device and thus control the advance of the transporting units along the guiding device inside the station.

In particular, according to the present disclosure, the control unit is configured to operate the advancing auxiliary device so that the advancing auxiliary device can switch, with no service interruption, from a first configuration, wherein the transporting units are individually arranged equidistant from each other and the boarding and landing occur inside the station without stopping the advancing movement, to a second configuration, wherein the transporting units are arranged in equidistant groups of at least two units and the boarding and landing occur inside the station by temporarily stopping the transporting units, and vice versa.

Advantageously, according to the present disclosure it is therefore possible to switch, with no service interruption, the configuration of the cable transportation system from a high-traffic configuration, in which the individual transporting units are close and equidistant to and from each other, to a low-traffic configuration, in which the transporting units are compacted in groups, and between one group and the other there is a greater distance than the distance between the individual transporting units during the high-traffic configuration. This greater distance between the groups enables a group of transporting units to be stopped relatively safely at the station without risk of collision with the preceding (i.e., upstream), group that is moving forward.

According to one embodiment of the disclosure, the guiding device comprises, in series, an inlet guide for decelerating the transporting units, an intermediate guide for boarding/landing, and an outlet guide for accelerating the transporting units. In this configuration, the advancing auxiliary device is configured for driving the transporting units with different acceleration and deceleration rates along the inlet and the outlet guide. In this way, advantageously, some transporting units can be brought relatively close together or spaced apart to provide the above equidistant groups or to re-establish the same distance between the individual units along the entire path.

In particular, the advancing auxiliary device may comprise a plurality of wheels arranged along the guiding device, wherein these wheels are configured for driving the transporting units to advance by friction. To enable different acceleration and deceleration rates along the inlet and the outlet guide, the wheels along such inlet and outlet guides can be equipped, for example, with inverter motorization or with a gear joint with at least two rates.

The cable transportation system comprises:

a plurality of transporting units;

at least one station as described previously;

at least one hauling or advancing, and possibly also supporting, cable for the transporting units outside the station. Alternatively, the supporting function outside the stations can be provided by at least one other cable, or supporting cable.

In certain embodiments, the control unit is also configured to vary the advancing speed of the hauling cable so that during the first, high-traffic configuration the cable is advanced at a higher speed than the corresponding advancing speed set during the second, low-traffic configuration.

The present disclosure also relates to the method for operating the system as described above. In particular, the method comprises the steps of:

(a) providing a cable transportation system as described above;

(b) operating the advancing auxiliary device so that the advancing auxiliary device can switch, with no service interruption, from a first configuration, wherein the transporting units are individually arranged equidistant from each other and the boarding and landing occur inside the station without stopping the advancing movement, to a second configuration, wherein the transporting units are arranged in compact and equidistant groups of at least two units and the boarding and landing occur inside the station by temporarily stopping the transporting units, and vice versa.

This step of operating the advancing auxiliary device is performed so as to drive the transporting units with different acceleration and deceleration rates along different portions of the inlet and the outlet guide.

In certain embodiments, said step of operating the advancing auxiliary device is performed so as to impart different acceleration and deceleration rates in the portions downstream and upstream of the inlet and the outlet guide, respectively, with respect to the remaining portion of the same inlet and outlet guides.

Lastly, the method also comprises the step of varying the advancing speed of the cable so that during the first, high-traffic configuration the cable advances at a relatively higher speed and during the second, low-traffic configuration the cable advances at a relatively lower speed.

BRIEF DESCRIPTION OF THE DRAWINGS

Further features and advantages of the present disclosure will be apparent from the following description of a non-limiting embodiment thereof, with reference to the figures of the accompanying drawings, wherein.

DETAILED DESCRIPTION

The present disclosure relates to a cable transportation system equipped with a station and the method for operating the system as regards the management of the advancing movement of the transporting units inside the station.

Figure 1:
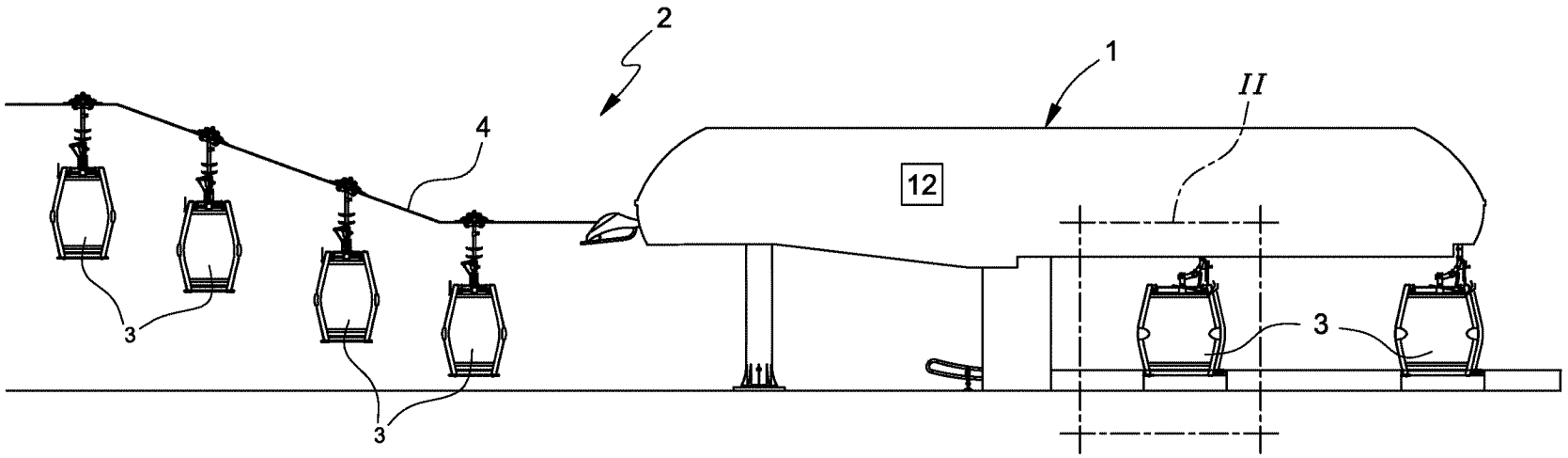
FIG. 1 is a schematic, side elevation view of a portion of a cable system equipped with a station according to the present disclosure.

FIG. 1 shows a schematic, side elevation view of a portion of a cable system 2 equipped with a station 1 according to the present disclosure. In particular, FIG. 1 shows a plurality of transporting units 3, in series and equidistant from each other, which are supported and driven outside the station 1 by a supporting/hauling cable 4. Alternatively, the system may comprise a hauling cable and at least one supporting cable. The reference numeral 12 in FIG. 1 schematizes a control unit configured to control the advancing movement of the transporting units 3 inside the station 1. However, this control unit 12 may also be used to control the entire system, for example to control the speed of the cable 4, therefore without providing one control unit per station.

Figure 3:
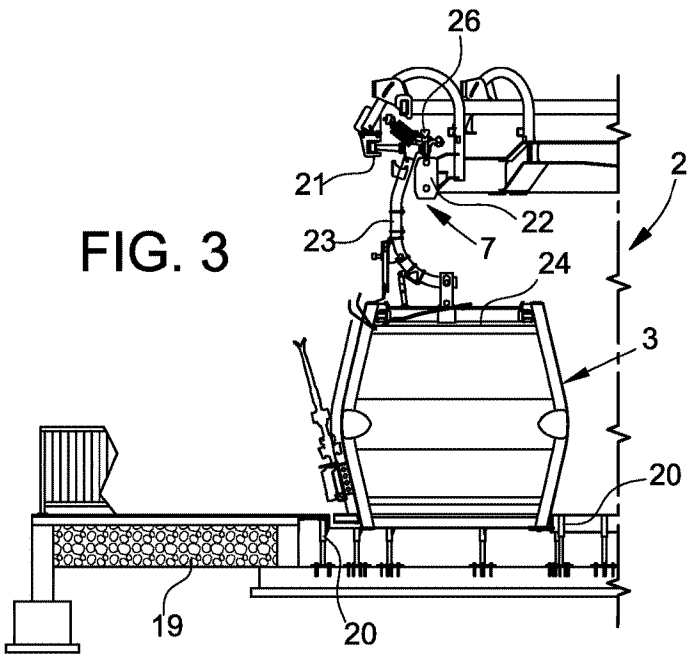
FIG. 3 is an elevation view of the detail of FIG. 2 along the lines showing an embodiment example of a device for guiding and supporting the transporting units during motion in the station.
Figure 2:
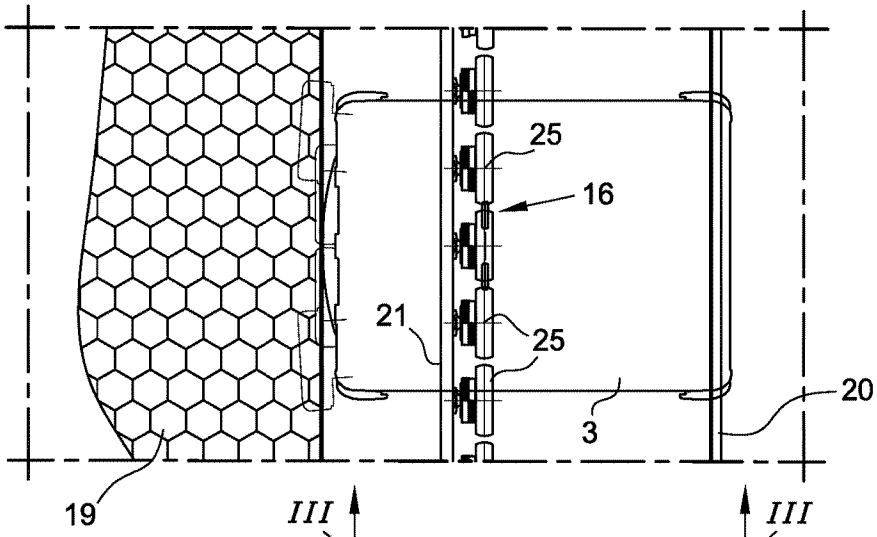
FIG. 2 is an enlarged view of a detail of FIG. 1 indicated with II and showing an embodiment example of the advancing auxiliary device operating inside the station and configured for advancing the transporting units when uncoupled from the cable.

FIGS. 2 and 3 show enlarged, elevation plan views of the detail indicated with II in FIG. 1. In particular, FIG. 2 shows a plan view of an embodiment example of an advancing auxiliary device 16 (in the form of a plurality of motorized wheels) operating inside the station 1 and configured for driving the transporting units 3 to advance when uncoupled from the cable 4. FIG. 3 shows an elevation view of an embodiment example of a guiding and supporting device 7 (in the form of at least one track guide) for the transporting units 3 during the advancing movement inside the station 1. According to this example, the guiding device 7 comprises a pair of tracks 21, 22 which support respective roller portions of a suspension arm 23 connected to the roof 24 of the transporting unit (i.e., a cabin 3). At the bottom, the cabin 3 is arranged between two sides 20 where, at one of these sides, a platform 19 is shown.

Inside the station, the advancing movement, acceleration and deceleration of the transporting unit along these tracks 21, 22 are imparted to the cabin 3 by a suitable advancing auxiliary device 16. In the example of FIG. 2, this advancing auxiliary device 16 comprises a plurality of motorized wheels 25, such as made of rubber, which act against a corresponding portion 26, which is, in certain embodiments, knurled, at the top of the suspension arm 23.

Figure 4:
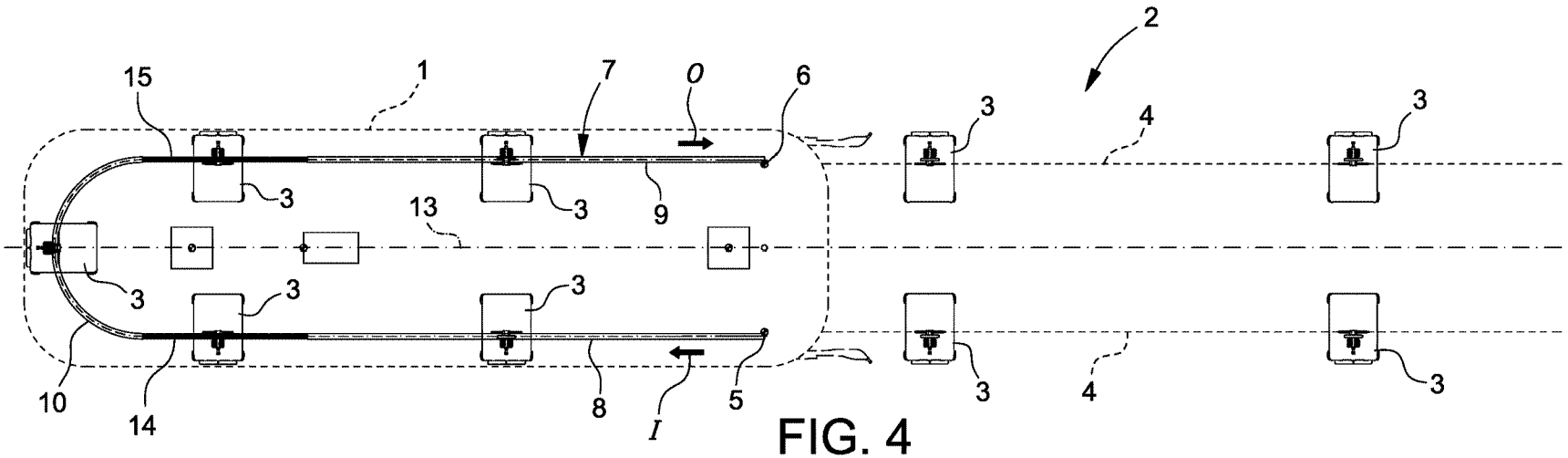
FIG. 4 is a plan view of a first, service configuration of the system of the present disclosure.

FIG. 4 shows a plan view of the path followed by the transporting units 3 inside the station 1 as well as immediately upstream and downstream thereof. Inside the station, the transporting units follow a path having a substantially U-shaped plan. In this respect, the station can be defined as an upstream or downstream station. However, the station of the present disclosure may also be an intermediate station, therefore without providing a U-shaped path. The direction of advance of the transporting units 3 is shown schematically in FIG. 4 as well as in FIGS. 5 and 6, the arrow I indicating the inlet of the station and the arrow O the outlet of the station. In particular, FIG. 4 shows a service configuration of the system 2 wherein the transporting units are all arranged equidistant from one another. This configuration can be defined as a high-traffic configuration because the distance between the units does not allow them to stop inside the station during the landing and boarding of passengers. A cable uncoupling device 4 is provided at the inlet of the station 1 (i.e., in the position indicated by reference numeral 5 in FIG. 4). Once the cable 4 has been uncoupled, the transporting unit entering the station 1 is supported by the inlet guide 8, which is a portion of a guiding device 7 extending from the inlet 5 to the outlet 6 of the station 1. The preceding FIGS. 2 and 3 show an embodiment example of said guiding device 7 and of the advancing auxiliary device 16 connected to the guiding device 7. Along the inlet guide 8, the transporting units 3 are slowed down so that they arrive at an intermediate guide 10 at a relatively low speed suitable for boarding and landing. In this configuration, the boarding and landing occur without stopping the transporting units 3, which advance at a constant speed along the intermediate guide 10. Downstream of the intermediate guide 10 there is an outlet guide 9 along which the transporting units 3 are accelerated to such a speed that they can be safely coupled with the cable 4. By way of example, the speed of the cable can be 5.5 meters/second, while the advancing speed along the intermediate guide 10 can be 0.3 meters/second. In the example of FIG. 4, the station 1 is shown as a return station with a U-shaped, in plan view, intermediate guide 10 and a longitudinal axis 13. The distance between the inlet guide and the outlet guide is such as to simultaneously enable the entry and exit of the transporting units into/from the station. To keep the transporting units 3 equidistant, the acceleration and deceleration rate is constant along the entire extent of the inlet 8 and the outlet 9 guide.

Figure 5:
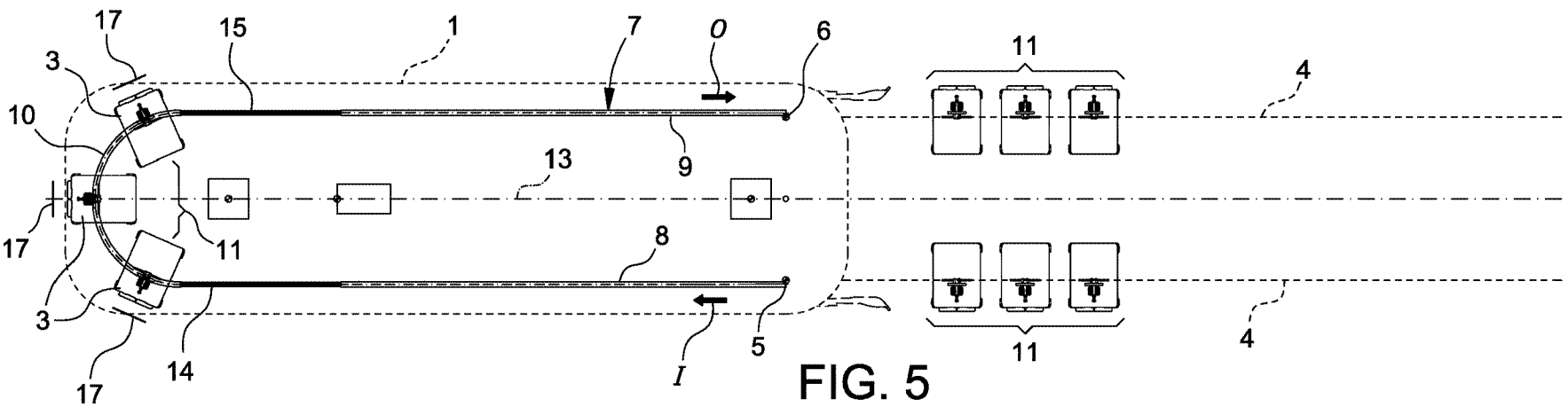
FIG. 5 is a plan view of a second, service configuration of the system of the present disclosure.

FIG. 5 shows a second, service configuration of the system 2. In this configuration, the transporting units 3 are no longer individually equidistant, but are mutually arranged in compact equidistant groups 11, and according to the example shown, each group 11 consists of three units 3. In particular, the distance between the groups 11 is greater than the distance between the individual units 3 in the configuration of FIG. 4. The number of units 3 in operation in the system in the configuration of FIG. 4 is the same as that in the configuration of FIG. 5. In certain embodiments, the advancing speed of the cable 4 in the configuration of FIG. 5 is lower than the corresponding speed in the configuration of FIG. 4. During the operating mode of FIG. 5, the distance between the groups 11 is such as to enable the groups themselves to stop along the intermediate guide 10 without risk of collision with the group 11 entering the station 1. In this configuration, the presence of platform doors can be envisaged, which are schematized in FIG. 5 with reference number 17, so as to provide an automatic operating station 1. Also in this configuration of FIG. 5, the acceleration and deceleration rate is constant along the entire extent of the inlet 8 and the outlet 9 guide.

Figure 7A:
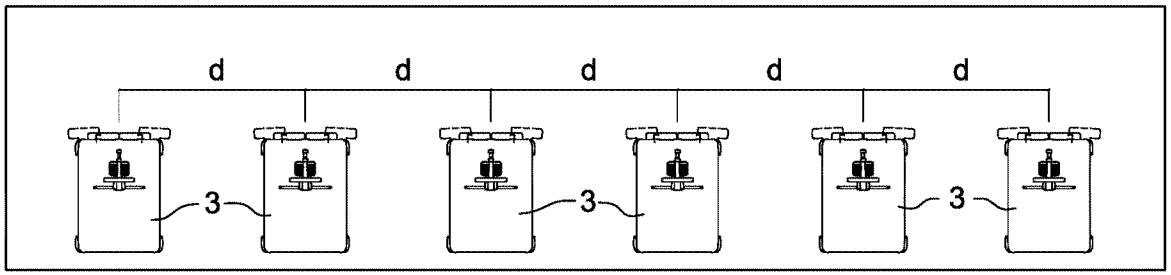
FIGS. 7A and 7B schematically show the mutual arrangement of the transporting units according to the first and the second service configuration of the system.
Figure 7B:
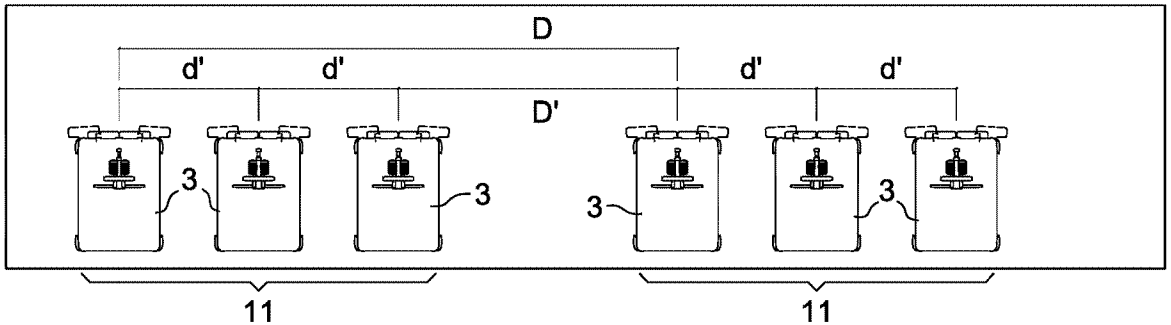

FIGS. 7A and 7B schematically show the mutual arrangement of the transporting units 3 according to the first and the second service configuration of the system, schematized in FIGS. 4 and 5.

According to the example in FIG. 7A, the speed of the cable 4 is 5.5 meters/second, while the gondolas 3 are mutually spaced apart by a distance d of 82.5 meters, corresponding to 15 seconds.

According to the example in FIG. 7B, the speed of the cable 4 is 3.5 meters/second. Within the single groups 11, the gondolas 3 are mutually spaced apart by a distance of 45.5 meters, corresponding to 13 seconds. The downstream gondola of one group is separated from the upstream gondola of the preceding group by a distance D' of 156.5 meters, corresponding to 44.71 seconds. The upstream gondola of one group is separated from the upstream gondola of the preceding group by a distance D of 247.5 meters, corresponding to 70.71 seconds.

Figure 6:
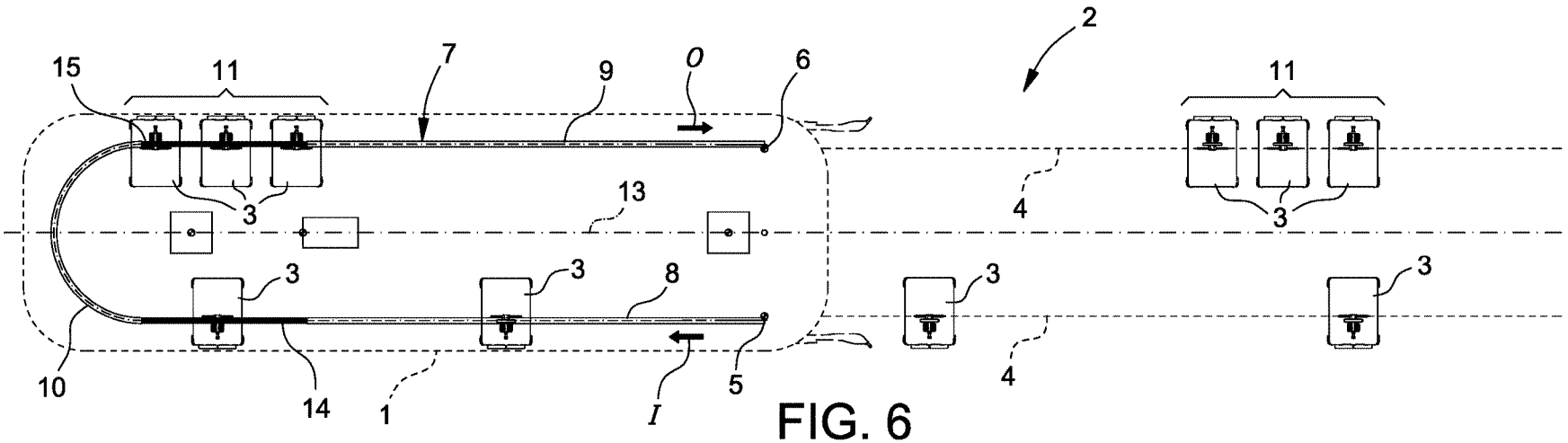
FIG. 6 shows the transition steps from the first to the second configuration of the system in the absence of service interruptions.

FIG. 6 schematically shows that the present disclosure enables the system 2 to be switched from the configuration of FIG. 4 to that of FIG. 5 without requiring service interruptions.

As shown, along the inlet guide 8, the transporting units 3 are initially fed equidistant to each other and are slowed down with a constant braking ratio along the entire inlet guide 8 until they reach the intermediate guide 10 with the expected landing/boarding speed, for example 0.3 meters/second.

Once the intermediate guide 10 has been covered, the transporting units 3 travel along a first, upstream portion of the outlet guide 9, indicated with 15 in FIG. 6, along which they are advanced at a first acceleration rate. In the next portion of the outlet guide 9 the transporting units 3 are advanced at a second acceleration rate, which is lower than the preceding one. Due to these different acceleration rates, the units 3 assemble together until they form a group 11. Once this group 11 is formed, the upstream portion 15 of the outlet guide 9 is temporarily operated with the same, relatively lower acceleration rate, to space the last cabin of the formed group 11 from the first cabin of the group 11 being formed. Once the desired distance between the groups 11 has been attained, the higher acceleration rate is restored along the upstream portion 15 of the outlet guide 9, in order to complete the second group 11 being formed. The sequence is repeated until completion of all the groups 11 along the path of the system 2. At this point and for the duration of the second service configuration, a constant acceleration rate is imposed along the outlet guide 9. In absolute terms, the acceleration ends when the speed reaches that of the cable 4, which, as indicated above, may also vary from configuration to configuration.

In order to bring the system 2 back to the high-traffic conditions of FIG. 4, the cabins 3 advancing in groups 11 are spaced apart by imposing different deceleration rates along the inlet guide 8. In particular, a relatively lower deceleration rate is imposed along the downstream portion 14 of the upstream guide 8, so as to separate the transporting units 3 to a greater extent until the desired distance compatible with the operation of the system 2 is reached without stopping for boarding and landing.

As is evident, both the transition from the configuration of FIG. 4 to that of FIG. 5, and vice versa, occur without service interruption of the system.

Lastly, it is clear that modifications and variations may be made to the disclosure described herein without departing from the scope of the appended claims. Accordingly, various changes and modifications to the presently disclosed embodiments will be apparent to those skilled in the art.

The invention claimed is:

1. A cable transportation system comprising:

a station comprising:

an inlet associated with an uncoupling device configured to uncouple each of a plurality of transporting units from a cable configured to drive the transporting units outside the station, an outlet associated with a coupling device configured to couple each of the transporting units to the cable;

a guiding device configured to guide the transporting units inside the station when the transportation units are uncoupled from the cable;

an advancing auxiliary device configured to move the transporting units along the guiding device; and a control unit configured to cause the advancing auxiliary device to switch, with no service interruption, from a first configuration to a second configuration, wherein in the first configuration, the transporting units are individually arranged outside the station equidistant from each other and a boarding and landing operation occurs inside the station without stopping an advancing movement of the transportation units and in the second configuration, the transporting units are arranged outside the station in equidistant compact groups of at least two of the transportation units and the boarding and landing operation occurs inside the station by temporarily stopping the advancing movement of the transporting units.

2. The cable transportation system of claim 1, wherein:

the guiding device comprises, in series:

an inlet guide configured to decelerate the transporting units, an intermediate guide configured to enable the boarding and landing operation, and an outlet guide configured to accelerate the transporting units; and the advancing auxiliary device is configured to drive the transporting units with different acceleration and deceleration rates along portions of the inlet guide and the outlet guide.

3. The cable transportation system of claim 2, wherein the advancing auxiliary device comprises a plurality of wheels arranged along the guiding device and configured to drive the transporting units to advance, by friction, with at least one group of wheels along the inlet guide and the outlet guide being provided with inverter motorization.

4. The cable transportation system of claim 2, wherein the advancing auxiliary device comprises a plurality of wheels arranged along the guiding device and configured to drive the transporting units to advance, by friction, with at least one group of wheels along the inlet guide and the outlet guide being provided with a gear joint with at least two rates.

5. The cable transportation system of claim 1, wherein the control unit is configured to vary an advancing speed of the cable such that in the first configuration, the cable advances at a first speed and in the second configuration, the cable advances at a second, lower speed.

6. A cable transportation system comprising:

a station comprising:

an inlet associated with an uncoupling device configured to uncouple each of a plurality of transporting units from a cable configured to drive the transporting units outside the station, an outlet associated with a coupling device configured to couple each of the transporting units to the cable;

a guiding device configured to guide the transporting units inside the station when the transportation units are uncoupled from the cable;

an advancing auxiliary device configured to move the transporting units along the guiding device; and a control unit configured to cause the advancing auxiliary device to switch, with no service interruption, from a first configuration to a second configuration, wherein in the first configuration, the transporting units are arranged outside the station in equidistant compact groups of at least two of the transportation units and a boarding and landing operation occurs inside the station by temporarily stopping an advancing movement of the transporting units and in the second configuration, the transporting units are individually arranged outside the station equidistant from each other and the boarding and landing operation occurs inside the station without stopping the advancing movement of the transportation units.

7. The cable transportation system of claim 6, wherein:

the guiding device comprises, in series:

an inlet guide, an intermediate guide configured to enable the boarding and landing operation, and an outlet guide; and the advancing auxiliary device is configured to drive the transporting units with different acceleration and deceleration rates along portions of the inlet guide and the outlet guide.

8. The cable transportation system of claim 6, wherein the control unit is configured to vary an advancing speed of the cable such that in the first configuration, the cable advances at a first speed and in the second configuration, the cable advances at a second, different speed.

9. A method for operating a cable transportation system, the method comprising:

causing an advancing auxiliary device of a station to switch, with no service interruption, from a first configuration to a second configuration, wherein in the first configuration, a plurality of transporting units are individually arranged outside the station equidistant from each other and a boarding and landing operation occurs inside the station without stopping an advancing movement of the transportation units along a guiding device of the station configured to guide the transportation units inside the station when the transportation units are uncoupled from a cable configured to drive the transportation units outside the station, and in the second configuration, the transporting units are arranged outside the station in equidistant compact groups of at least two of the transportation units and the boarding and landing operation occurs inside the station by temporarily stopping the advancing movement of the transporting units along the guiding device of the station, and causing the advancing auxiliary device of the station to switch, with no service interruption, from the second configuration to the first configuration.

10. The method of claim 9, wherein causing the advancing auxiliary device of the station to switch, with no service interruption, from the first configuration to the second configuration comprises controlling the advancing auxiliary device to drive the transporting units with different acceleration and deceleration rates along an inlet guide of the guiding device and an outlet guide of the guiding device, the guiding device comprising, in series, the inlet guide associated with a deceleration of the transporting units, an intermediate guide associated with the boarding and landing operation and the outlet guide associated with acceleration of the transporting units.

11. The method of claim 10, wherein different portions of the inlet guide are associated with different deceleration rates and different portions of the outlet guide are associated with different acceleration rates.

12. The method of claim 9, further comprising varying an advancing speed of the cable such that during the first configuration, the cable advances at a first speed and during the second configuration, the cable advances at a second, lower speed.

* * * * *